US009108785B2

(12) United States Patent
Weinrich

(10) Patent No.: US 9,108,785 B2
(45) Date of Patent: Aug. 18, 2015

(54) CIGARETTE LIGHTER PACK

(71) Applicant: Matthew Weinrich, Richland Hills, TX (US)

(72) Inventor: Matthew Weinrich, Richland Hills, TX (US)

( * ) Notice: Subject to any disclaimer, the term of this patent is extended or adjusted under 35 U.S.C. 154(b) by 82 days.

(21) Appl. No.: 13/921,535

(22) Filed: Jun. 19, 2013

(65) Prior Publication Data

US 2014/0374283 A1 Dec. 25, 2014

Related U.S. Application Data

(60) Provisional application No. 61/662,497, filed on Jun. 21, 2012.

(51) Int. Cl.
*B65D 85/10* (2006.01)

(52) U.S. Cl.
CPC ..... *B65D 85/109* (2013.01)

(58) Field of Classification Search
USPC ..... 206/85, 86, 87, 88, 89; 431/253
See application file for complete search history.

(56) References Cited

U.S. PATENT DOCUMENTS

| | | | | |
|---|---|---|---|---|
| 3,976,194 | A | 8/1976 | Loredo | |
| 4,595,352 | A | 6/1986 | Endelson | |
| 5,558,217 | A | 9/1996 | Focke et al. | |
| 5,746,587 | A | 5/1998 | Racine et al. | |
| 6,223,891 | B1 | 5/2001 | Devens et al. | |
| 2006/0266662 | A1 * | 11/2006 | Sugiharto | 206/86 |

FOREIGN PATENT DOCUMENTS

| | | | | |
|---|---|---|---|---|
| CH | 682442 | A5 * | 9/1993 | A24F 15/10 |

* cited by examiner

*Primary Examiner* — Anthony Stashick
*Assistant Examiner* — James M Van Buskirk
(74) *Attorney, Agent, or Firm* — Buckingham, Doolittle & Burroughs, LLC

(57) ABSTRACT

A cigarette pack and lighter device is disclosed that provides a way for smokers to always have a lighter on hand. The cigarette pack and lighter device comprises a container for retaining a plurality of cigarettes, and an extended section secured to the container for retaining a lighter. The extended section comprises at least one opening for accessing a thumb spark clicker and/or a vented flame hole of the lighter, so that a user can access the lighter without having to remove the lighter from the extended section. Typically, the openings are covered with a perforated cardstock material that can be torn away by the user to access the thumb spark clicker and/or the vented flame hole of the lighter, such that the user can light the cigarettes with the provided lighter.

15 Claims, 5 Drawing Sheets

CIGARETTE LIGHTER PACK

CROSS-REFERENCE

This application claims priority from Provisional Patent Application Ser. No. 61/662,497 filed Jun. 21, 2012.

BACKGROUND

Many smokers try to keep a lighter with them so they will always have a way to light their cigarettes. Typically, smokers may purchase several lighters to keep around the house and/or in the car, at work, etc., but these lighters may run out of fuel or go missing when they need them. Further, smokers may become frustrated as they fumble for a functional lighter when trying to light a cigarette. Also, newer vehicles do not always come with cigarette lighters in the power jack and even when they do, the lighters that are manufactured in vehicles are not always reliable. A solution is needed to ensure that smokers always have a lighter available when needed.

The present invention provides a way for smokers to always have a lighter available. The cigarette pack and lighter combination device is designed as a marketing concept for cigarette companies. Each company may package their own cigarettes in the container at the top with a slim lighter positioned at the bottom of the container. The lighter may provide just enough fuel (e.g., butane) for the cigarettes housed in the container. Thus, cigarette companies may attract new customers by providing smokers with a built-in lighter in their cigarette packs. Anyone who regularly smokes and/or buys cigarettes may appreciate the convenience afforded by this device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a cigarette pack and lighter combination device that provides a way for smokers to always have a lighter available when needed. The cigarette pack and lighter device comprises a container for retaining a plurality of cigarettes, and an extended section secured to, or an integral part of the container for retaining a lighter. Typically, the container comprises an interior cavity that retains the plurality of cigarettes. The cigarettes can be menthol cigarettes, low-tar cigarettes, low-nicotine cigarettes, natural cigarettes or regular cigarettes. The cigarette pack and lighter device further comprises an extended section that is secured to, or an integral part of the bottom end of the container for retaining a lighter. The lighter can be any suitable size, style, and/or color as is known in the art without affecting the overall concept of the invention, as long as the lighter can be housed within and retained by the extended section.

In a preferred embodiment, a user can utilize the lighter without having to remove the lighter from the extended section. Specifically, the extended section can comprise at least one opening for accessing a thumb spark clicker and/or a vented flame hole of the lighter. Typically, the openings are covered with a perforated cardstock material, or any other suitable material known in the art that can be torn away by the user to access the thumb spark clicker and/or the vented flame hole of the lighter. Furthermore, the container and the extended section can be formed as an integral piece and manufactured from a single blank of material, or the container and the extended section can be formed as two separate pieces and manufactured from two blanks of material and then secured together via any suitable securing means as is known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
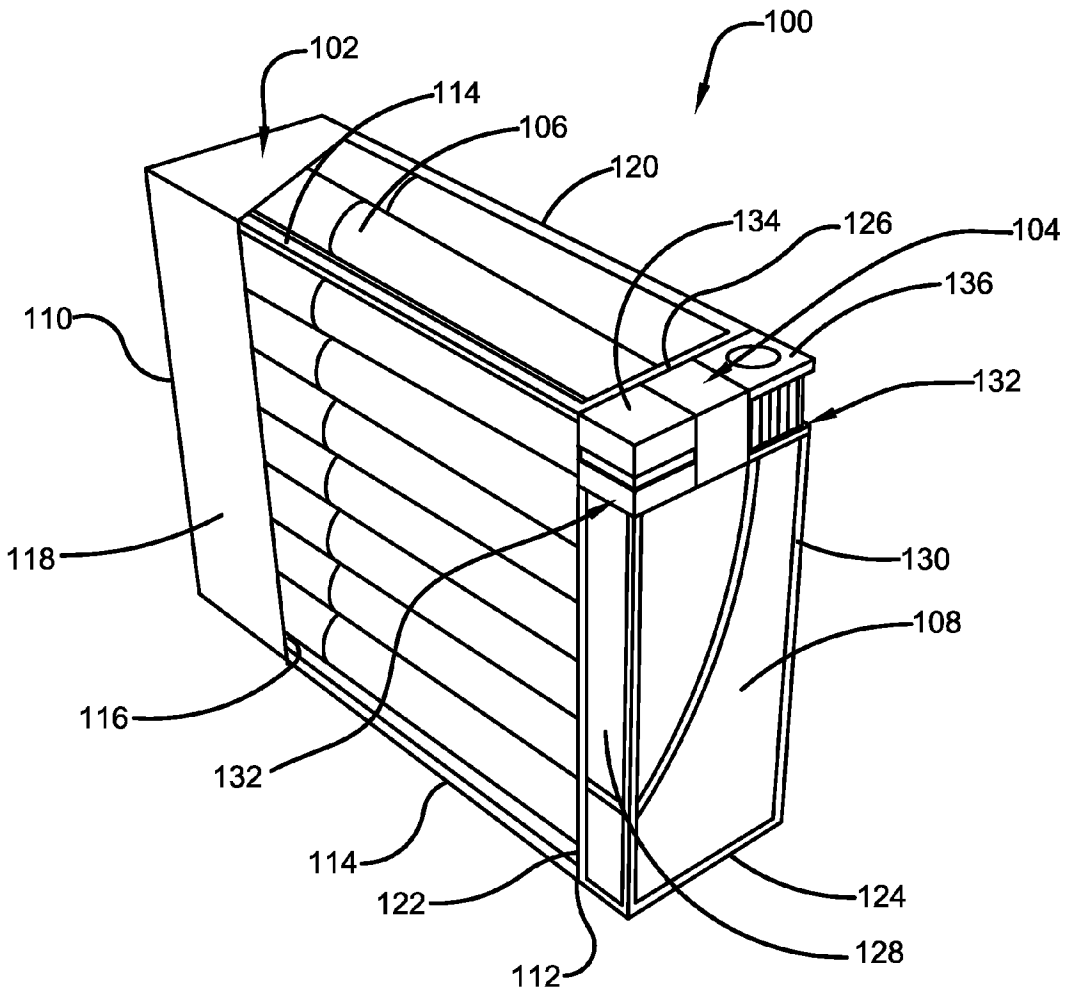
FIG. 1 illustrates a transparent perspective view of the cigarette pack and lighter device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a combination cigarette pack and lighter device that provides a way for smokers to always have a lighter available. The cigarette pack and lighter combination device is designed as a marketing concept for cigarette companies. Each company may package their own cigarettes in the container at the top with a slim lighter positioned at the bottom. The lighter may provide just enough fuel for the cigarettes housed in the container, which typically number twenty. Thus, cigarette companies may attract new customers by providing smokers with a built-in lighter in their cigarette packs. Anyone who regularly smokes and/or buys cigarettes may appreciate the convenience afforded by this device.

The disclosed cigarette pack and lighter device preferably comprises a container for retaining a plurality of cigarettes, and an extended section secured to, or an integral part of the container for retaining a lighter. Typically, the extended section is secured to the bottom end of the container for retaining the lighter. The extended section comprises at least one opening for accessing a thumb spark clicker and/or a vented flame hole of the lighter, so that a user can access the lighter without having to remove the lighter from the extended section. Typically, the openings are covered with a perforated cardstock material that can be torn away by the user to access the thumb spark clicker and/or the vented flame hole of the lighter, such that the user can light the cigarettes with the provided lighter without removing the lighter from the extended section.

Figure 2:
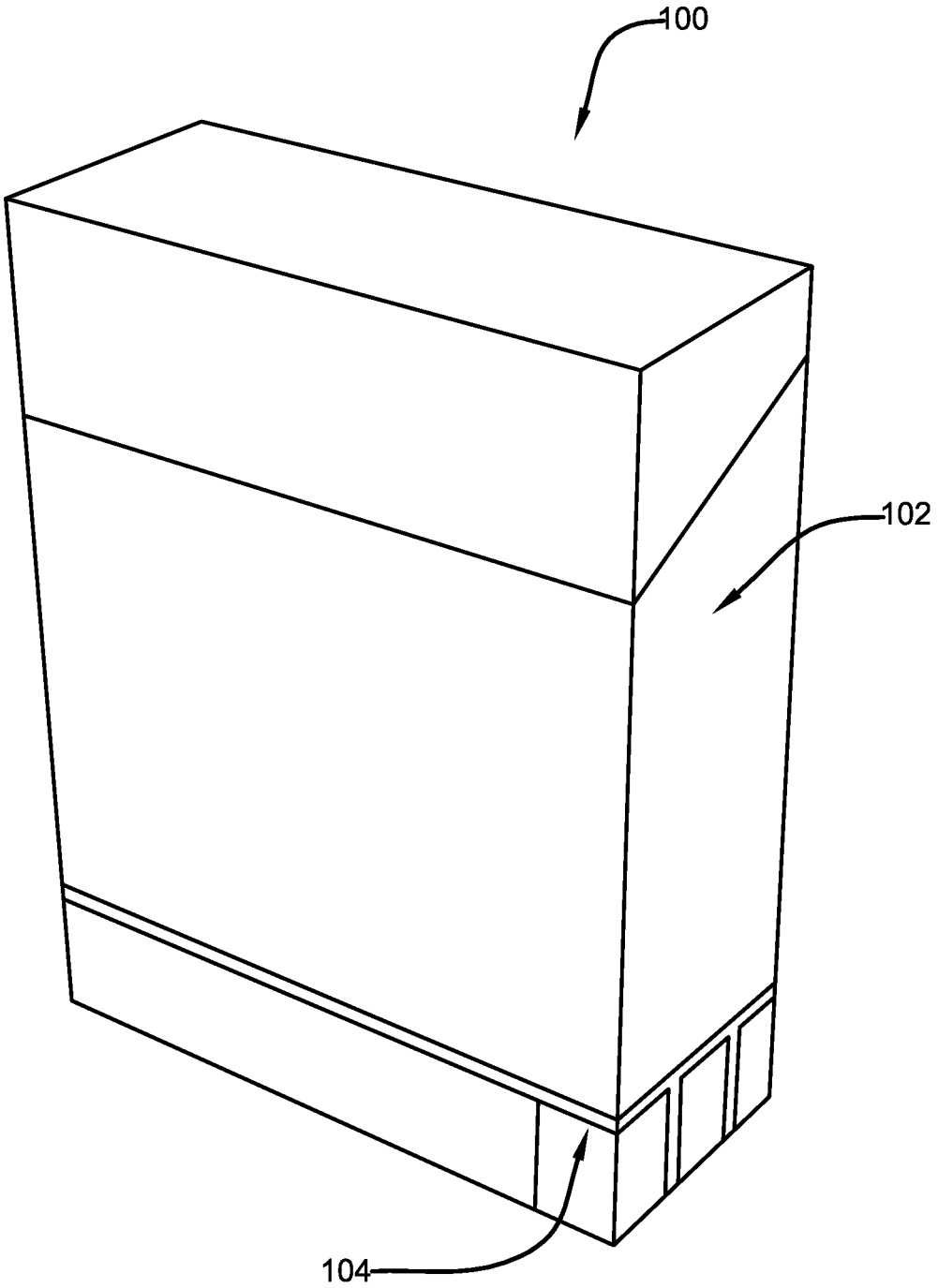
FIG. 2 illustrates a perspective view of the cigarette pack and lighter device in accordance with the disclosed architecture.

Referring initially to the drawings, FIGS. 1-2 illustrate the cigarette pack and lighter device 100 that provides a way for smokers to always have a lighter available for use. The cigarette pack and lighter device 100 comprises a container 102 for retaining a plurality of cigarettes 106, and an extended section 104 secured to, or an integral part of the container 102 for retaining a lighter 108 (as shown in FIG. 1).

The container 102 comprises a top end 110, a bottom end 112, opposing sides 114, and an interior cavity 116 for receiving the cigarettes 106. Typically, the container 102 is rectangular in shape, however any other suitable shape can be used as is known in the art without affecting the overall concept of the invention. The container 102 would generally be constructed of heavy duty cardstock, plastic, aluminum, flame resistant material, etc., though any other suitable material may be used to manufacture the container 102 as is known in the art without affecting the overall concept of the invention.

The container 102 can also comprise a variety of colors and designs to suit user and manufacturing preference. The container 102 is approximately between 3.4 and 6.0 inches long as measured from the top end 110 to the bottom end 112, and approximately between 1.5 and 3.5 inches wide as measured between opposing sides 114, and approximately between 0.8 and 2.0 inches thick as measured from a front surface 118 to a back surface 120.

Typically, the container 102 is hollow, but it does not have to be and can function by being partly solid, as long as a plurality of cigarettes 106 can be retained within the interior cavity 116 (as shown in FIG. 1) and accessed by a user. The cigarettes 106 can be any type of smoke-able tobacco product commonly known in the art such as menthol cigarettes, low-tar cigarettes, low-nicotine cigarettes, natural cigarettes, regular cigarettes, cigars, etc. Natural cigarettes include clove cigarettes, kreteks, and flavored cigarettes. In addition to tobacco, these cigarettes contain various flavorings, such as ground cloves, clove oil, and/or candy-like flavors, such as chocolate, cherry, and mango. Another type of "natural" cigarette is an herbal cigarette. This cigarette is made from a blend of herbs, such as passion flower, jasmine, and ginseng, etc. Regular cigarettes are typically filtered and include reconstituted tobacco and other additives.

The cigarette pack and lighter device 100 further comprises an extended section 104 that is secured to, or an integral part of the container 102 for retaining a lighter 108 (as shown in FIG. 2). Typically, the extended section 104 is secured to, or an integral part of the bottom end 112 of the container 102, but can be secured to any other suitable position on the container 102 or integrally formed with container 102. The lighter 108 typically functions as a prior art lighter known in the art, and can be any suitable size, style, and/or color as is known in the art without affecting the overall concept of the invention, as long as the lighter 108 can be housed within and retained by the extended section 104.

Typically, the extended section 104 is rectangular in shape, however any other suitable shape can be used as is known in the art without affecting the overall concept of the invention, as long as the extended section 104 can retain a lighten 08. The extended section 104 would generally be the same width and thickness of the container 102 and would generally be constructed of the same materials as the container 102, such as heavy duty cardstock, plastic, aluminum, flame resistant material, etc., though any other suitable material may be used to manufacture the extended section 104 as is known in the art without affecting the overall concept of the invention.

Further, the container 102 and the extended section 104 can be formed as an integral piece and manufactured from a single piece of material (or single blank), or the container 102 and the extended section 104 can be formed as two separate pieces and manufactured from two pieces of material (or two blanks) and then secured together. The two pieces would be secured together via gluing, welding, etc., or any other suitable securing means as is known in the art.

Additionally, the extended section 104 may be detachable from the container 102, allowing a user to remove the lighter 108 from the extended section 104, and allowing the user to remove the entire extended section 104 from the container 102. In contrast, the extended section 104 can remain attached to the container 102, and a user can access the lighter 108 without having to remove the lighter 108 from the extended section 104. For example, the extended section 104 can comprise at least one opening 132 for accessing a thumb spark clicker 134 (or a roller and flint clicker, or any other suitable lighting mechanism as is known in the art) or a vented flame hole 136 of the lighter.

In a preferred embodiment, the extended section 104 comprises at least two openings 132, one opening that allows access to the thumb spark clicker 134 and a second opening that allows access to the vented flame hole 136, however any suitable number of openings 132 can be provided on the extended section 104 to allow access to the lighter 108. Typically, the openings 132 are covered with a perforated cardstock material 138, or any other suitable material known in the art that can be torn away by the user to access the thumb spark clicker 134 and the vented flame hole 136 of the lighter 108.

Figure 3:
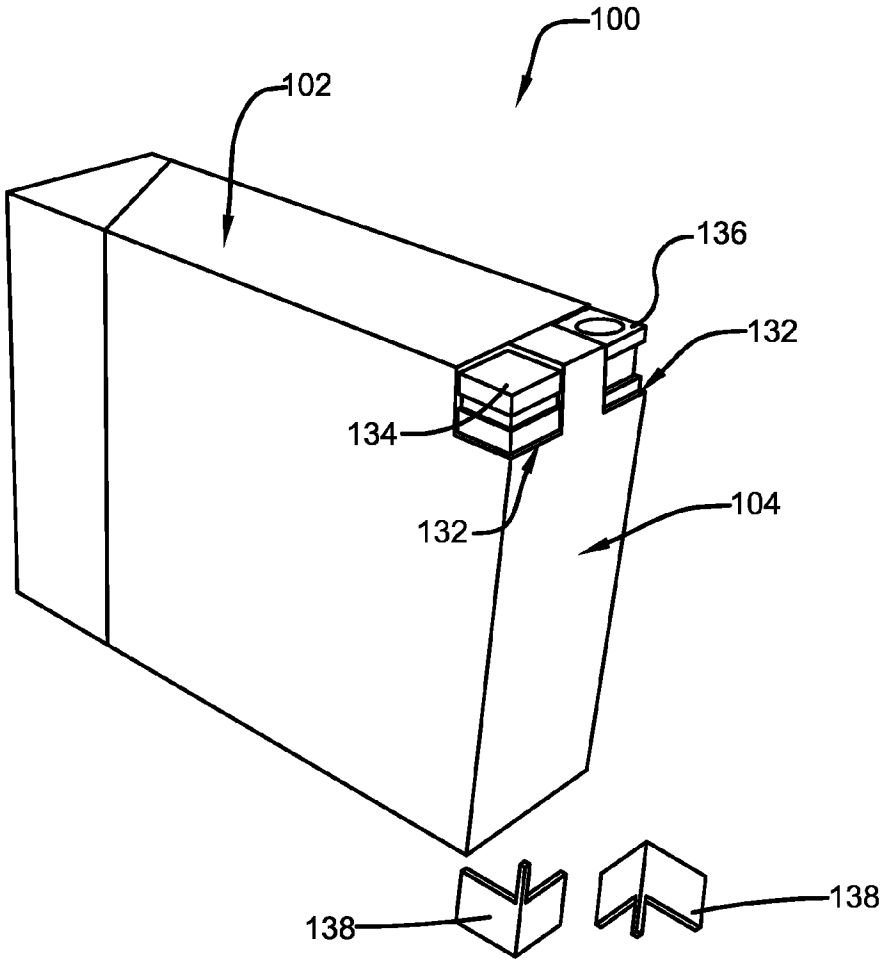
FIG. 3 illustrates a perspective view of the perforated pieces and the cigarette pack and lighter device in accordance with the disclosed architecture.
Figure 4:
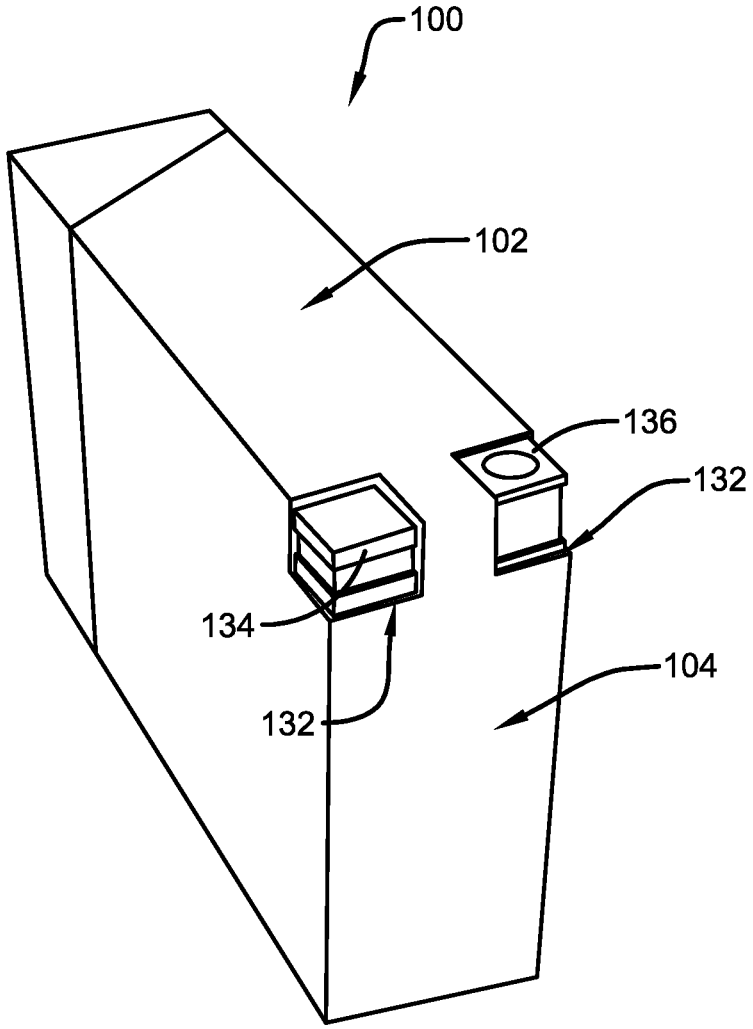
FIG. 4 illustrates a perspective view of the cigarette pack and lighter device with the perforated pieces removed in accordance with the disclosed architecture.

FIGS. 3-4 illustrate the perforated pieces (or material) 138 of the cigarette pack and lighter device 100. As stated supra, a user can access the lighter 108 without having to remove the lighter 108 from the extended section 104. For example, the extended section 104 can comprise at least one opening 132 for accessing a thumb spark clicker 134 or a vented flame hole 136 of the lighter. In a preferred embodiment, the extended section 104 comprises at least two openings 132, one opening that allows access to the thumb spark clicker 134 and a second opening that allows access to the vented flame hole 136, however any suitable number of openings 132 can be provided on the extended section 104 to allow access to the lighter 108.

Furthermore, the openings 132 are typically covered with a detachable, perforated cardstock material 138, or any other suitable perforated material known in the art that can be torn away by the user to access the thumb spark clicker 134 and the vented flame hole 136 of the lighter 108 (as shown in FIG. 3). The openings 12 are typically covered for safety reasons, to prevent children from accessing the lighter 108. The material is typically perforated, such that a user can rip away the sections of material 138 to expose the openings 132 (as shown in FIG. 4), however the material does not have to be perforated, and the device 100 can function with solid material as well, as long as the solid material can be detached from the extended section 104 to expose (and allow access to) the openings 132.

Figure 5:
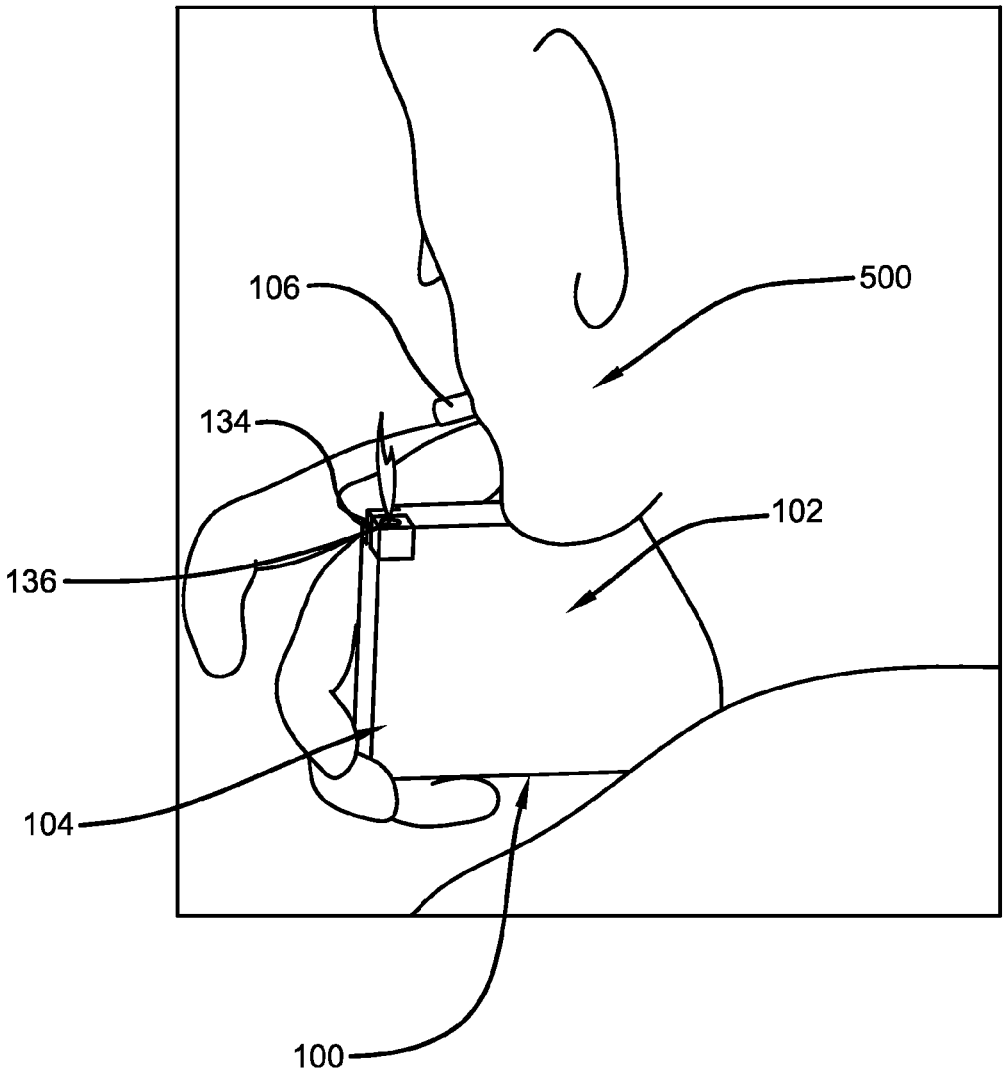
FIG. 5 illustrates a perspective view of the cigarette pack and lighter device in use in accordance with the disclosed architecture.

FIG. 5 illustrates the cigarette pack and lighter device 100 in use. In operation, a user 500 would choose the size and/or type of cigarettes 106 that meets their needs and/or wants, such as menthol cigarettes, low-tar cigarettes, low-nicotine cigarettes, natural cigarettes, regular cigarettes or cigars. The user 500 would then remove the perforated material (or pieces) 138 from the extended section 104 of the container 102 via detaching the perforations and ripping the material away from the extended section 104 to expose the openings 132.

The user 500 then removes a cigarette 106 from the container 102 and holds the end of the cigarette 106 over the flame hole 136 of the lighter 108. The user 500 then pushes the clicker 134 of the lighter 108 until a flame is produced and the cigarette 106 is lit. Once lit, the user 500 can smoke the cigarette 106 and store away the cigarette pack and lighter device 100 without detaching the lighter 108 from the device 100. Thus, the cigarette pack and lighter device 100 provides a way for smokers to always have a lighter 108 available when needed by removably attaching said lighter to a pack of cigarettes.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cigarette pack and lighter device comprising:

a container for retaining a plurality of tobacco products, comprising a top end, a bottom end, opposing sides, and an interior cavity; and an extended section attached to the bottom end of the container for retaining a lighter; and wherein a user can access the lighter without removing the lighter from the extended section; and wherein the extended section comprises at least one opening for accessing a thumb spark clicker of the lighter and a second opening for accessing a vented flame hole of the lighter; and wherein the at least one opening and the second opening are covered with a perforated cardstock material that can be torn away by the user to access the thumb spark clicker and the vented flame hole; and wherein the container and the extended section are manufactured of heavy duty cardstock.

2. The device of claim 1, wherein the container and the extended section are comprised of a single piece of material.

3. The device of claim 1, wherein the container and the extended section are comprised of two pieces of material and then secured together.

4. The device of claim 1, wherein the container and the extended section are manufactured of flame resistant material.

5. The device of claim 1, wherein the container retains a plurality of natural cigarettes.

6. The device of claim 1, wherein the container retains a plurality of regular cigarettes.

7. A cigarette pack and lighter device comprising:

a container for retaining a plurality of cigarettes, comprising a top end, a bottom end, opposing sides, and an interior cavity; and an extended section attached to the bottom end of the container for retaining a lighter, comprising a first opening for accessing a thumb spark clicker of the lighter, and a second opening for accessing a vented flame hole of the lighter; and wherein a user can access the lighter without removing the lighter from the extended section; and wherein the first opening and the second opening are covered with a perforated cardstock material that can be torn away by the user to access the thumb spark clicker and the vented flame hole.

8. The device of claim 7, wherein the container and the extended section are comprised of a single blank.

9. The device of claim 7, wherein the container and the extended section are comprised of two blanks and then secured together.

10. The device of claim 7, wherein the container and the extended section are manufactured of heavy duty cardstock.

11. The device of claim 7, wherein the container and the extended section are manufactured of flame resistant material.

12. The device of claim 7, wherein the container retains a plurality of natural cigarettes.

13. The device of claim 7, wherein the container retains a plurality of regular cigarettes.

14. A cigarette pack and lighter device comprising:

a container for retaining a plurality of cigarettes, comprising a top end, a bottom end, opposing sides, and an interior cavity; and an extended section which is an integral part of the bottom end of the container for retaining a lighter, comprising a first opening for accessing a thumb spark clicker of the lighter, and a second opening for accessing a vented flame hole of the lighter;

wherein the first opening and the second opening are covered with a perforated cardstock material that can be torn away by a user to access the thumb spark clicker and the vented flame hole; and wherein the user can access the lighter without removing the lighter from the extended section.

15. The device of claim 14, wherein the container retains a plurality of natural cigarettes.

* * * * *